United States Patent [19]

Weiner

[11] Patent Number: 4,985,811

[45] Date of Patent: Jan. 15, 1991

[54] AQUA LIGHT

[76] Inventor: Mark W. Weiner, One University Pl. #11F, New York, N.Y. 10003

[21] Appl. No.: 504,841

[22] Filed: Apr. 5, 1990

[51] Int. Cl.[5] ..... F21V 33/00

[52] U.S. Cl. ..... 362/101

[58] Field of Search ..... 362/101, 96

[56] References Cited

U.S. PATENT DOCUMENTS 2,141,769 12/1938 Simpson ..... 362/101

4,591,955 5/1986 Kallay ..... 362/101

*Primary Examiner*—Carroll B. Dority

*Attorney, Agent, or Firm*—John P. Halvonik

[57] ABSTRACT

A light projecting device that projects shimmering light, preferably colored, upon the walls and ceilings of a room. The light shimmers as it is cast on the walls and resembles light reflected from a pond or other body of water. The device consists of an oblong container that contains a rotating bar that moves inside it. The container has water or oil inside it and this gives the effect of light shimmering on water.

4 Claims, 1 Drawing Sheet

AQUA LIGHT

BACKGROUND OF THE INVENTION

1. Field of the Invention

The invention relates to the field of illumination and, more particularly, to those lighting devices that are meant to cast colored images upon the walls. The present invention casts images that appear to shimmer as if they are reflected from a pond or other body of water.

2. Description of the Prior Art

Similar lighting devices that use colored liquids to cast images are known. See for example, U.S. Pat. Nos. 2,520,691; 3,387,782 and 4,352,149. None of these provide a device that provides a projection of light that resembles shimmering water.

SUMMARY OF THE INVENTION

A lighting fixture which casts the appearance of shimmering water onto walls and ceilings. The fixture comprises a rectangular or similarly shaped chamber that contains water or other liquid and a rotating, wave-shaped bar within the container that causes wave-like movement of the water. A bank of lights is positioned underneath the chamber and serves to illuminate the churning water. Colored gels may be placed on the top of the liquid container for additional effect. The lights cast the shimmering water upon the walls and ceiling of a room. The speed of the movement of the bar can be set a various speeds to vary the effect and the intensity of the lights can be varied to set the mood of the room.

It is the object of this invention to provide a lighting fixture that can provide the appearance of light shimmering a body of water upon a room.

Another object of the invention is to provide a lighting fixture that can vary the rate of movement of shimmering light so as to set the mood of a room.

Still another objective is to provide a lighting fixture that has a low voltage intake to prevent electrical hazards.

Yet another object is to provide a shimmering lighting fixture on which colored gels, prisms or crystals can be placed to provide colored light.

DESCRIPTION OF THE PREFERRED EMBODIMENT

Figure 1:
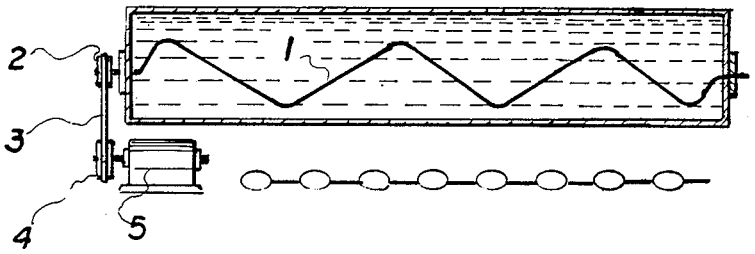
FIG. 1 shows the apparatus ready for use.
Figure 2:
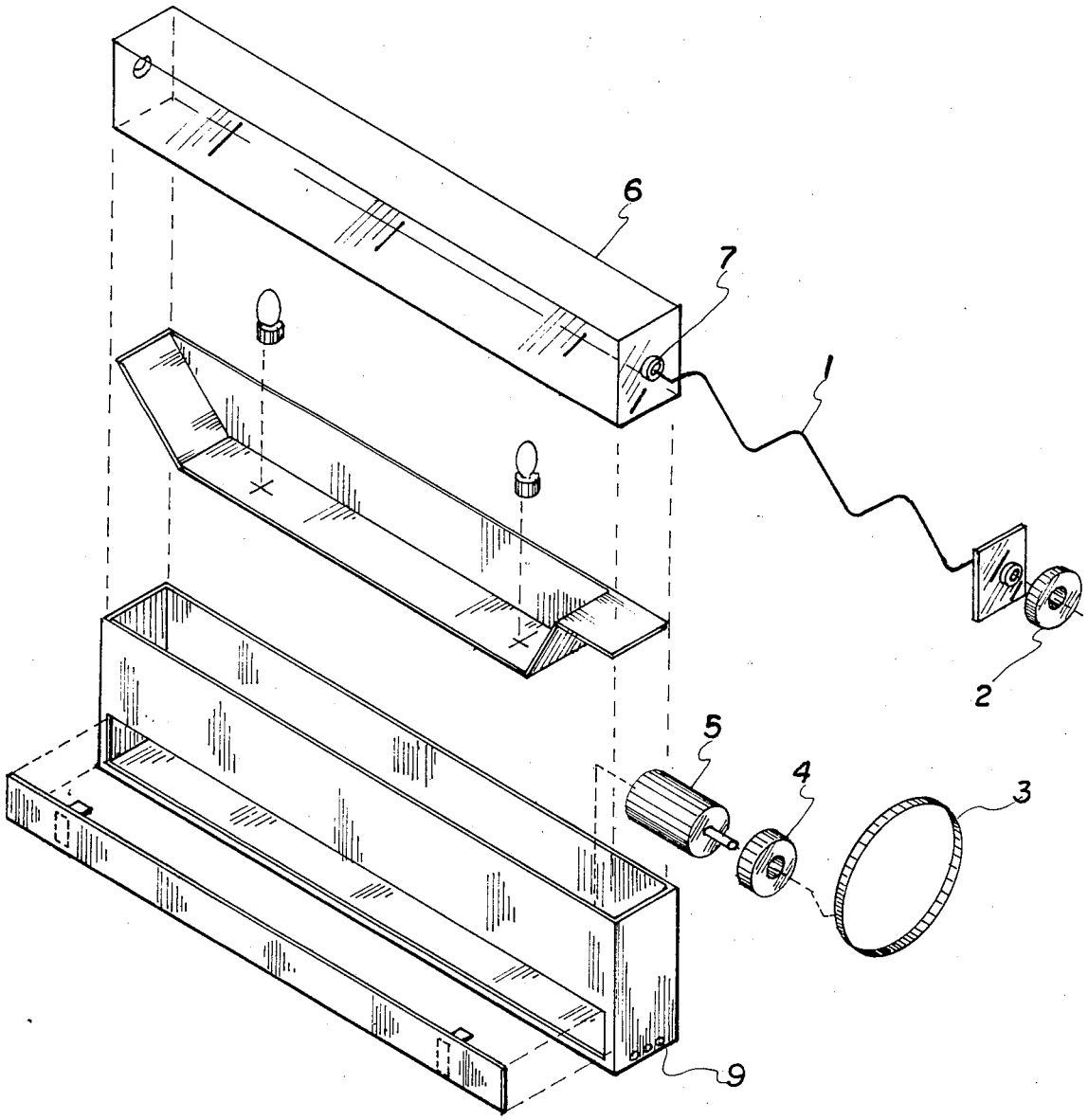
FIG. 2 shows an exploded view.

The lighting fixture is a rectangular or other shaped container that can be made with glass or other transparent walls, see FIG. 1. The shape of the container is not crucial to the functioning of the apparatus, but should be of a shape that would permit the formation of waves within the container from a rotating bar 1 placed within the container. It is preferred that the top of the liquid chamber 8 be flat so as to facilitate the placement of colored gels or crystals on the top of the chamber. It is also not crucial that the material used for the walls of the chamber be glass, any similar transparent material will do.

The container may container water but it is preferred that the liquid be oil or some other liquid with a boiling point substantially greater than that of room temperature. This is because water will tend to form a mist within the walls of the container unless the container is filled completely with water. This problem can be partially compensated for by filling the chamber about 98% full of water. At this level of water, the waves formed will be of an approximate size to just splash the top of the chamber where the mist forms and to clean off the mist. Using the dimensions of the present invention there is, preferably, approximately $\frac{1}{8}$ to $\frac{1}{4}$ of an inch of space from the water level to the top of the container when the water is still. This, of course, can vary and also the size of the waves will vary with the speed of the wave bar. It would not do well to fill the container to the very top with water. This would vastly decrease the size of the waves that are formed in the container, and, this would detract from the shimmering effect produced by the invention. Also, the misting produced by leaving space between the water level and the top of the container tends to detract from the effect of the light being projected through the container, because it blurs the images produced.

Inside the container is a wave shaped bar 1 that runs the entire length of the chamber, see FIG. 1. This bar is encased in a watertight casing 7 leaving the bar to extend about $\frac{1}{2}$ inch outside one of the walls of the container. To this extension a pulley 2, 4 is attached. The pulley is attached to a motor 5 which controls the speed of the pulley, which, in turn, controls the speed of the turning of the wave shaped bar 1. Thus, the motor allows for variable speed control of the wave bar since it can be set for different speeds. The bar revolves in the water or other liquid and its shape creates waves which are projected onto walls and ceilings by the bank of lights beneath the container. Thus, the illumination of the waves creates the appearance of shimmering light reflected from a body of water such as a pond. The bar may be made of aluminum or other sturdy material. The material is unimportant so long as it can exist in a wet enviroment for the life of the apparatus.

The inside contains a chamber preferably of a rectangular shape and made of glass or similar material like plastic. measuring 2"(H)×23.5"(L)×2"(W). The dimensions are not critical to the functioning or other capabilities of the aqua light, those mentioned are merely suggestive. Those mentioned are preferred as this allows for a slim design that can be placed in an obscure location.

This chamber contains the wave shaped bar 1 that extends the inside length of the chamber. By "wave-shaped" it is meant that the bar comprises a series of bent portions, each portion alternately bending in one direction and then another. The bar thus resembles the standard sine curve or simply a wavy line. The bar projects outside one wall of the chamber to which a pulley is attached. This pulley is fastened to the inside bottom of the light fixture shell. Preferably directly under the bar which extends from outside one wall of the chamber is a small, low volt, motor 5 from which a belt 3 connects the motor to the bar. This motor rotates the bar inside the glass case through the water, which is filled to 98% capacity. This action creates the wave effect.

Beneath the container is a bank of lights that serve to illuminate the liquid in the chamber. These can be of any ordinary size, strength, etc. It is preferred that the lights be of low voltage for safety considerations. When the light is on and the motor is operating the movement of the wave bar will create a reflective light effect. The effect is meant to simulate the shimmering of light on water. At both ends of the fixture, are small holes plugged with pins 9 that allow for the attachment of another fixture to extend the length.

The preferred dimensions are 2"(H)×23.5"(L)×2"(W). Preferably, the entire fixture is constructed of 18 AWG aluminum. The front of the fixture can be separated to facilitate changing the light bulbs. The top of the fixture 8 is clear glass.

Colored gels, prisms and crystals can be placed on top of the fixture to alter the reflected image. This is an advantage because it takes only a few seconds to change the color gel to create the a preferred lighting enviroment. There is also little mess, since the water or liquid is not touched. There can also be a dimmer switch for the lighting instrument. The speed of the rotating bar can be varied to create variations of the water movement.

The low voltage of the fixture allows it to be safely connected to an outlet with a transformer or can be permanently installed by an electrician.

One of the advantages of this lighting apparatus is that the speed of the motor that controls the bar can be varied. By varying the speed of the bar the turbulence in the container changes and different effects can be created. These can be varied for instance, to match the mood of the person or the surroundings. At high speed there is a lot of turbulence in the container and the mood is vibrant and exciting, this can be enhanced with the use of colored gels that match the mood, perhaps reds and yellows. At low speed, the mood is subdued and solemn and appropriate colors can be used.

I claim:

1. An apparatus for projecting light images that simulate shimmering light comprising:

an enclosed liquid storage container having transparent walls and a liquid in said container, a wave bar held within said container, said bar comprising a series of bent portions so as to resemble a sine wave, said bar capable of revolving and capable of creating waves in said liquid, a source of light located near said container and capable of shining light through said container.

2. The apparatus of claim 1 wherein said wave bar is in connection with a pulley means and said pulley means is connected to a motor, said motor capable of moving said bar at various speeds.

3. The apparatus of claim 2 wherein colored material is placed on the top surface of said container, said material capable of reflecting colored light when light is shone through said material.

4. The apparatus of claim 3 wherein said container is filled to about 70–98% of capacity.

* * * * *